United States Patent [19]

Biersach

[11] Patent Number: 4,796,009

[45] Date of Patent: Jan. 3, 1989

[54] ELECTRONIC WARNING APPARATUS

[75] Inventor: James E. Biersach, Mequon, Wis.

[73] Assignee: Alerting Communicators of America, Mequon, Wis.

[21] Appl. No.: 23,678

[22] Filed: Mar. 9, 1987

[51] Int. Cl.[4] ..... G10K 11/02

[52] U.S. Cl. ..... 340/388; 181/144; 381/156

[58] Field of Search ..... 340/388; 181/144, 147; 381/156, 159, 182

[56] References Cited

U.S. PATENT DOCUMENTS 4,700,177 10/1987 Nakashima ..... 340/388

*Primary Examiner*—Joseph A. Orsino
*Assistant Examiner*—Annie H. Chau
*Attorney, Agent, or Firm*—James E. Nilles; James R. Custin

[57] ABSTRACT

The outdoor alerting and warning device of this invention comprises numerous electronic drivers and an axially shallow drum-shaped resonance chamber having an inside diameter equal to a whole-number multiple of one-quarter of the wavelength of a sound wave of predetermined frequency. The drivers are mounted on the exterior of the resonance chamber, on its peripheral portion at regular circumferential intervals around it, with their ports opening into its interior. A coaxial outlet port in one end wall of the resonance chamber, having an area of between one-half and two times the total of driver port areas, opens into the throat of a horn; or each end wall may have such an outlet port, each opening into a horn throat.

8 Claims, 3 Drawing Sheets

ELECTRONIC WARNING APPARATUS

FIELD OF THE INVENTION

This invention relates to high-powered electronic outdoor alerting and warning apparatus and is more particularly concerned with an electronic apparatus for delivering both high volume siren tones and highly amplified voice outputs, capable of operating with an electric power input on the order of several kilowatts and of efficiently converting such electrical energy to sound energy.

BACKGROUND OF THE INVENTION

Heretofore electromechanical sirens have been employed for producing very high sound volumes. Such a siren comprises a so-called chopper which is rotatably driven by an electric motor and which produces air pressure pulses at a sonic frequency. An electromechanical siren can be readily designed for a power input on the order of 15 to 25 Kw. With such power, and being reasonably efficient in converting electrical energy into sound energy, an electromechanical siren can produce a tone signal that is readily audible at distances of more than a mile.

An important disadvantage of an electromechanical warning apparatus is that it can produce only tone outputs and can therefore signal only a very limited number of conditions and/or instructions. Because of this limitation, there has been an increasing use of electronic apparatus for outdoor public alerting and warning, capable of producing both siren-type tone outputs and highly amplified voice outputs. In the case of an alerting and warning apparatus installed, for example, in connection with a chemical plant or a nuclear electric power plant, it is not sufficient merely to warn the public that a potentially hazardous condition has developed; the public must also be informed about the protective measures that should be taken under the circumstances, because the measures that are appropriate will differ from case to case depending upon the nature and severity of the hazardous condition and upon ambient conditions such as wind direction. For such situations the needed information can be satisfactorily conveyed only in highly amplified voice transmissions.

An outdoor electronic alerting and warning apparatus comprises one or more loudspeakers or drivers, each having a diaphragm that is usually enclosed in a rigid housing which cooperates with the diaphragm to define in front of it an acoustical impedance chamber with a restricted output port. The housing also defines a closed chamber behind the diaphragm that contains a permanent magnet secured to the housing and a coil secured to the diaphragm. When the coil is energized with an alternating current, it cooperates with the magnet to cause vibration of the diaphragm that imparts acoustical energy to the air in front of the diaphragm.

If the diaphragm of such a driver were to confront free air, very little load would be imposed upon it, and the excursions of the diaphragm, controlled only by its own stiffness and mass, could attain such amplitude that the diaphragm would be damaged. Instead, the acoustical impedance chamber in front of the diaphragm, with its restricted output port, imposes a load upon the diaphragm that limits its excursions to safe amplitude values. The impedance chamber also improves transfer of energy from the diaphragm to the free air. In heretofore conventional apparatus, such energy transfer is further improved by connecting the driver to an appropriately designed horn that has a narrow throat portion and diverges to a flaring mouth. The outlet port of the driver impedance chamber opens coaxially into the throat portion of the horn, which provides a restricted channel that further loads the diaphragm. The divergent front portion of the horn is designed for projection of the sound output in a desired beam width.

The properties of air are such that there tends to be an upper limit to the load that can be imposed upon a driver diaphragm by acoustical impedance means, and correspondingly there tends to be an upper limit to the electrical power that can be safely applied to the driver. In the present state of the art that power limit is on the order of 100 to 125 watts, with 200 watts attainable in special cases. To obtain acoustic outputs corresponding to substantially higher power inputs, it is therefore necessary to incorporate a number of electronic drivers into outdoor alerting and warning apparatus of the type here under consideration. In the usual case each of the several drivers is connected with its own individual horn throat. The several horn throats may merge into large mouth portion that is common to all of them, as disclosed in UK Pat. No. 327,145 and U.S. Pat. No. 4,344,504, but even then the apparatus has large overall dimensions. The importance of structural compactness in an outdoor alerting and warning device will be immediately apparent from the fact that such a device is ordinarily mounted on a tower to be at a level of 35 to 60 feet above the ground and must be capable of withstanding winds of the highest expectable velocities, typically taken as 145 mph. Thus, U.S. Pat. No. 4,344,504 discloses an arrangement comprising sixteen 125 watt drivers aligned vertically in a structure that was approximately 96 in. (2.44 m) high and 24 in. (61 cm) wide, producing an 800 Hz tone with a measured sound level of 127 dBA at 100 ft. However, this array was markedly directional, so that at least three more similar arrays would have been needed for an omnidirectional output, constituting an ensemble of massive dimensions that would have been subjected to correspondingly high wind loads.

To keep outdoor electronic alerting devices within size limits suitable for the wind loads they must be able to sustain, it has heretofore been conventional to incorporate no more than a limited number of drivers in such a device, sixteen being the usual maximum. What this means is that the input to such a device cannot ordinarily exceed 2 Kw, and its output is correspondingly low so that voice messages delivered by it cannot be consistently heard and understood at distances of more than about half a mile (800 m). Where greater coverage is needed, multiple units are employed, sited at uniformly spaced intervals across the area to be covered. This arrangement has several disadvantages. Its initial cost is high because of the need for multiple mounting towers. Maintenance may be complicated because of the need for periodic visits to numerous dispersed sites, as for checking the condition of the storage batteries that power each unit. Coordinating the operation of the several units presents the problem that radio transmissions may be subjected to interference and the like while wired connections are susceptible to cutting and breakage. And, in operation, a person located in hhe overlapping output patterns of two or more such units hears echo-like distortions that tend to garble spoken messages.

SUMMARY OF THE INVENTION

The general object of this invention is to provide an outdoor electronic alerting and warning apparatus for producing highly amplified voice outputs as well as tone outputs, capable of handling power inputs on the order of several kilowatts and efficiently converting them to high volume sound outputs, said apparatus thus comprising a large number of drivers but being nevertheless compact enough for conventional tower mounting without posing unusual wind load problems.

Another object of the invention is to provide an electronic outdoor warning and alerting apparatus of the character described that comprises a large number of drivers cooperating to provide a single sound source with a high enough output level to be readily audible at distances of a mile or more.

It is also an object of this invention to provide an electronic outdoor alerting and warning device comprising a large number of drivers (typically 48) arranged for cooperation with a single horn that can be optionally designed for either a directional or an omnidirectional output in accordance with the requirements of the particular installation.

From the foregoing it will be apparent that a further object of the invention is to provide outdoor warning and alerting apparatus that can be located at a single site but is nevertheless capable of producing both tone and voice outputs that are audible over an area having a radius of a mile or more, thus avoiding the disadvantages of the multiple units at spaced locations that were heretofore needed for satisfactory coverage of such an area.

Another and more specific object of the invention is to provide outdoor alerting and warning apparatus which achieves all of the above-stated objectives, provides a high level of acoustical output in relation to the electrical power supplied to it, is extraordinarily compact in relation to its capabilities, and is nevertheless low in cost, being no more expensive than prior apparatus of equivalent capability and in fact being less expensive than such prior apparatus when the cost of mounting towers is taken into account.

Another specific object of this invention is to provide an outdoor alerting and warning apparatus comprising a large number of electronic drivers that are connected to a horn or horns through a single resonance chamber which is common to all of the drivers and which acoustically loads them and cooperates with the horn or horns in transferring energy to the free air.

These and other objects that will appear as the description proceeds are achieved by the electronic alerting and warning apparatus of this invention, which comprises a plurality of substantially identical drivers, each of which comprises a diaphragm, electromagnetic means for converting electric currents at audio frequencies into like-frequency vibrations of the diaphragm, and housing means cooperating with the diaphragm to define at a front side thereof an acoustic impedance chamber having a restricted driver port. The apparatus is characterized by rigid means having a pair of opposite end wall portions connected by a peripheral wall portion, defining a resonance chamber that has an interior peripheral surface which is concentric to an axis and which has a diameter equal to a whole number multiple of one-quarter of the wave length of a sound wave of a predetermined frequency, and opposite interior end surfaces spaced apart by a distance which is not substantially greater than the diameter of said driver port. The rigid means is apertured to provide a plurality of input ports, one for each of said drivers, opening into the peripheral portion of the resonance chamber at substantially regular intervals around the same, and output port means opening coaxially from the resonance chamber and having a total area which is no less than half nor greater than two times the sum of the areas of the driver ports of said drivers. The drivers are secured to said rigid means at the exterior of the resonance chamber, with the driver port of each driver communicated with the resonance chamber through the input port for the driver.

In preferred embodiments of the invention, the output port means opens from the resonance chamber through only one of the end wall portions of the rigid means, and the apparatus further comprises a horn secured to the rigid means, said horn having a restricted throat portion into which said output port means opens.

In another embodiment of the invention, which is bidirectional and is suitable for special situations, both of the end wall portions of the rigid means are apertured to provide the output port means, and the apparatus further comprises a pair of horns, one for each of the end wall portions of the rigid means, each having a restricted throat, and said horns are secured to said rigid means with their throats adjacent to their respective end wall portions and with the output port means opening into their throats.

The output port means can comprise a single central aperture in one end wall portion, or in each end wall portion; or it can comprise a pattern (e.g., a ring) of apertures in one end wal portion, or in each end wall portion, such apertures being arranged near said axis and in substantially symmetrical relation to it.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
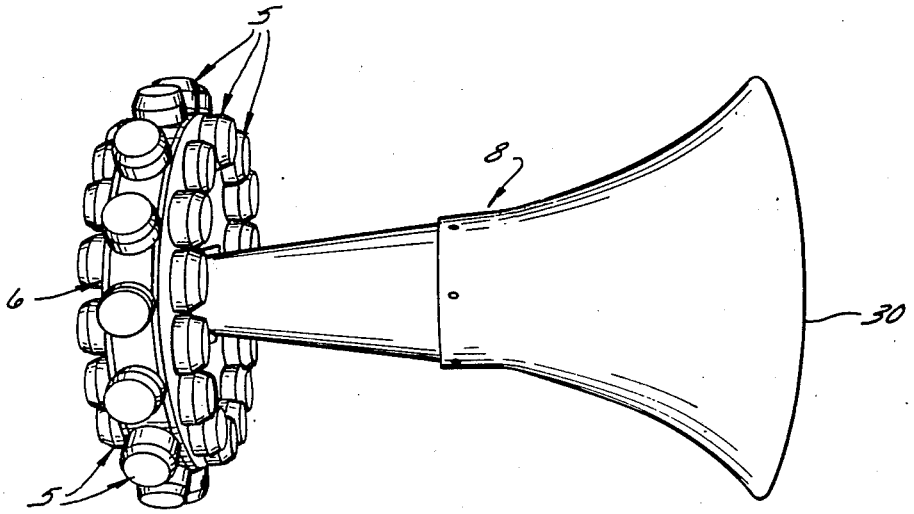
FIG. 1 is a side perspective view of an alerting and warning apparatus embodying the principles of this invention.
Figure 2:
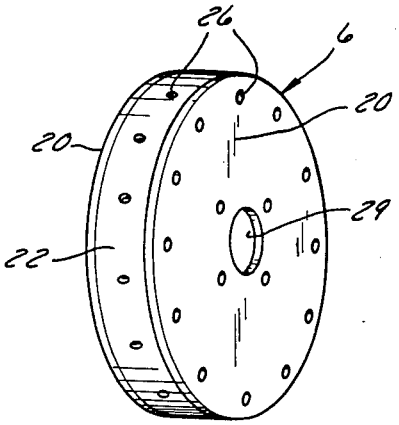
FIG. 2 is a perspective view of the drum-like structure that comprises the resonance chamber, with the drivers and horn removed.
Figure 3:
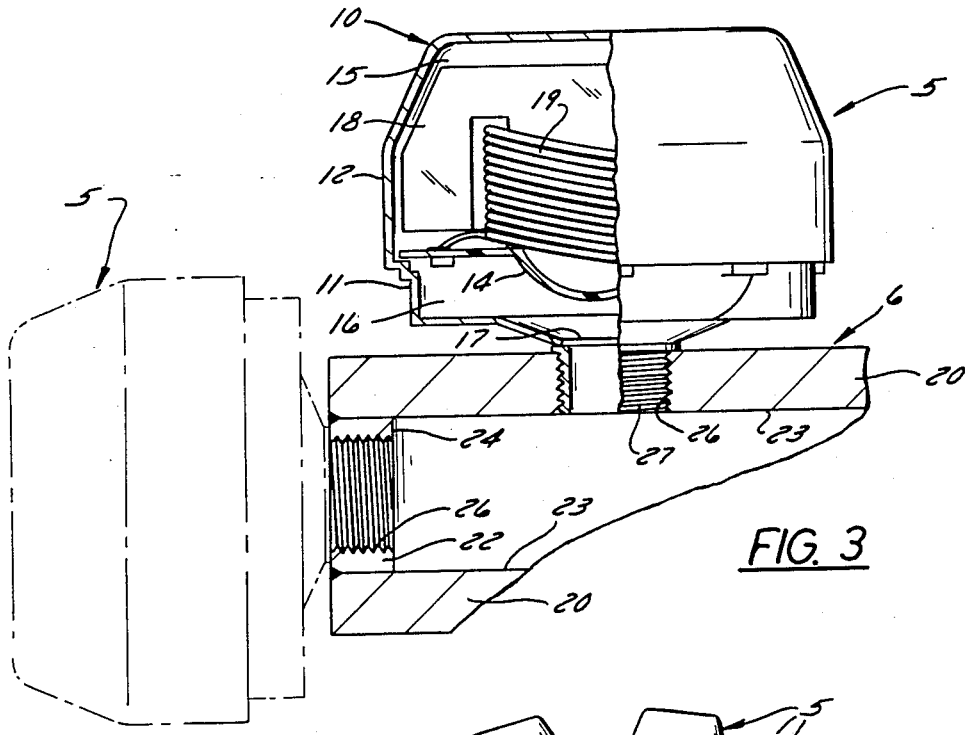
FIG. 3 is a fragmentary view, partly in section and partly in elevation, showing the relationship between the resonance chamber structure and a pair of drivers.
Figure 4:
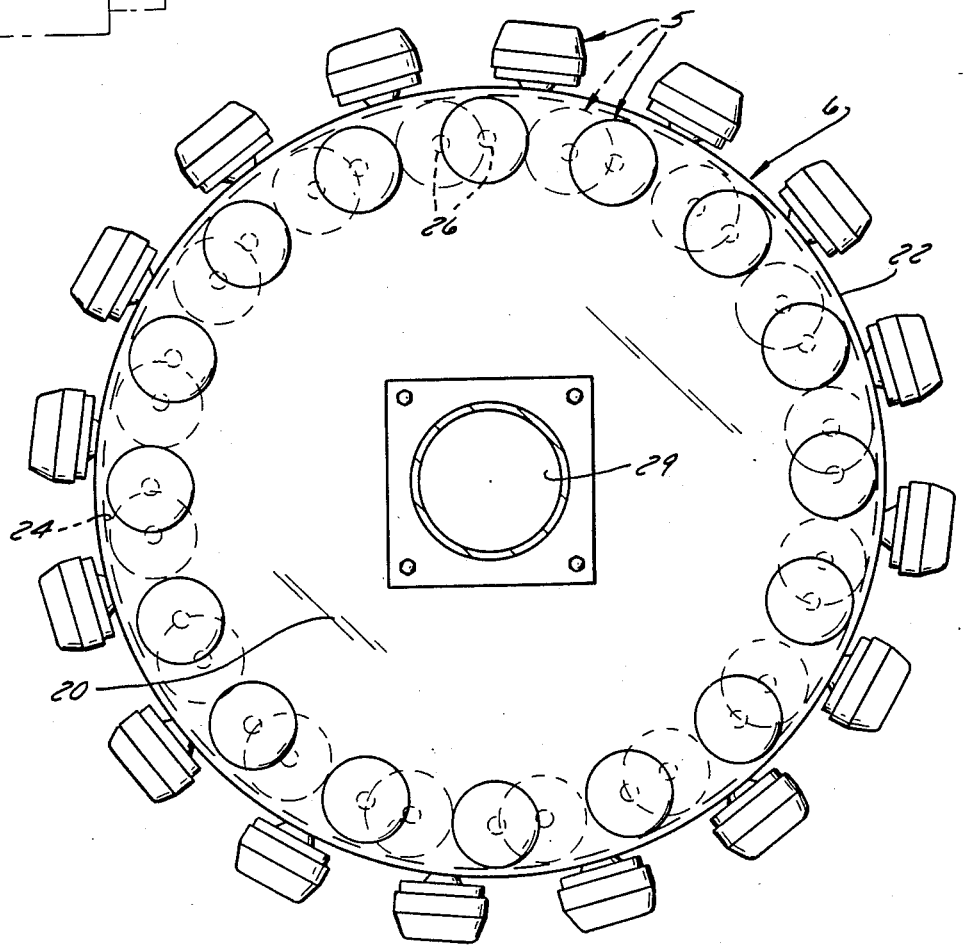
FIG. 4 is a view of the apparatus taken on a plane normal to the axis of the resonance chamber and through the throat of the horn.

An outdoor alerting and warning apparatus that embodies the principles of this invention comprises, in general, a plurality of preferably identical electromagnetic drivers 5 of a generally conventional type, rigid drum-like structure 6 which defines in its interior a cylindrical, axially shallow resonance chamber 7 and to which the drivers 5 are secured in an arrangement described hereinafter, and at least one horn 8 which is coaxially secured to the rigid structure.

Each of the drivers 5 has a rigid housing 10, conventionally comprising substantially dome-shaped front and rear castings 11 and 12 which are coaxially secured to one another in clamping relationship to the rim of a diaphragm 14. The diaphragm thus divides the interior of the driver housing 10 into a rear chamber 15 that is totally enclosed and a front chamber 16 in which there is a driver port 17 that is opposite the diaphragm and coaxial with it. In the rear chamber 15 of the driver housing a permanent magnet 18 is secured to that housing and a coil 19 is secured to the diaphragm 14. As is well known, the coil 19, when energized with an alternating current, cooperates with the magnet 18 to actuate the diaphragm 14 in back and forth oscillations that are in step with the alternations of the energizing current. The driver port 17 at the front of the front chamber 16 provides a restricted outlet from that chamber so that the front chamber can load the diaphragm as explained above. A typical commercially available driver of the type here described, well suited to the present invention, is sold by Atlas Sound Company as its model SA 370.

To define the resonance chamber 7, the rigid structure 6 comprises opposite end wall portions 20 that are connected by a peripheral wall portion 22. These wall portions are rigid enough not to vibrate under the acoustical energy applied to them. In a successful test model, the rigid structure was made of half-inch thick aluminum plates, but aluminum castings are considered very suitable.

The cylindrical resonance chamber 7 in the interior of the rigid structure 6 can have substantially flat opposite end surfaces 23. These surfaces are spaced apart by a distance which does not substantially exceed the diameter of the driver port 17. The interior surface 24 of the peripheral wall portion 22, which can be cylindrical, has a diameter which is equal to a whole number multiple of one-fourth of the wavelength of a sound wave of a selected frequency. In most cases the inside diameter of the cylindrical wall portion 22 will be equal to the full wavelength (four times the quarter wavelength) of a sound wave of the selected frequency, but if upper harmonics are desired its diameter may be equal to one-fourth or one-half of that wavelength. The frequency selected as the basis for this inside diameter of the resonant chamber structure is preferably that of a siren tone to be emitted by the apparatus. Thus, in the usual case an installation intended for producing a 560 Hz tone output has an inside diameter of 28 in. (0.71 m), whereas one intended for a 650 Hz peak output will have an inside diameter of 24⅛ in. (0.61 m).

The drivers 5 are attached to the rigid structure 6 with the driver port 17 of each driver opening into the peripheral portion of the resonance chamber 7 through a registering input port 26 in the rigid structure. The input ports 26 are spaced apart at regular circumferential intervals around the resonance chamber. In commercially available drivers, and particularly the Atlas SA 370, the front housing casting 11 is formed with an integral forwardly projecting externally threaded nipple 27 around its driver port 17, and the input port 26 for the driver can be a matingly threaded hole in the rigid structure into which this nipple is tightly screwed to secure the driver in place.

As here shown, 48 drivers are secured to the rigid structure 6. Sixteen of these are secured to its peripheral wall portion 22 at regular circumferential intervals around it so that their driver ports 17 open towards the axis of the resonance chamber 7. Another 16 drivers are secured to each end wall 20, as close as possible to the peripheral wall 22 and in each case at regular circumferential intervals around the end wall. The drivers on one end wall 20 are offset in one circumferential direction from those on the peripheral wall 22, while those on the opposite end wall 20 are offset in the opposite circumferential direction from the drivers on the peripheral wall, and these offsets are of such magnitude that there is a driver at every 7½° interval around the resonance chamber. Obviously a greater or lesser number of drivers can be used than the 48 here illustrated, depending upon output requirements, but for best results the drivers will in any case be spaced substantially uniformly around the rigid structure.

The axial depth of the resonance chamber, as measured between the inside surfaces 23 of its end walls 20, should be as shallow as possible, to maintain an acoustic load on all of the drivers, and is thus not substantially larger than is necessary for the nipples 27 of the drivers on the pheriphal wall 22 to be received between the end walls.

Because the drivers are arranged as just described, the sound pressure waves produced by them move radially through the resonance chamber, towards and from its axis, and can be visualized as resembling the ripples caused by dropping a pebble into the center of water in a circular bowl.

Sound energy leaves the resonance chamber through coaxial output port means 29 opening into the horn 8, which, as here shown, has a flange plate 30 secured to its throat end that is bolted to end wall 20 in flatwise overlying relation thereto. In the embodiment of the invention illustrated in FIG. 1, only one of the end wall portions 20 of the rigid structure is apertured to provide the output port means 29, and a single horn 8 is mounted on the rigid structure, in coaxial relation to the resonance chamber. In the embodiment shown in FIG. 5, both end wall portions of the rigid structure are coaxially apertured to provide output port means, and two horns 8, 8[1] are coaxially mounted on the rigid structure, each projecting from one of its end wall portions. The output port means 30 can be defined either by a single coaxial aperture in one end wall, or in each of the end walls, or by a pattern of relatively small apertures (arranged in a ring or in a circular area), in one end wall or in each end wall. Where the outlet port means is defined by a pattern of small apertures, all such apertures in an end wall must open into the throat of the horn on that end wall and must therefore be near the axis of the resonance chamber and disposed in a pattern substantially symmetrical to that axis.

In any case, the total area of the outlet port means 29 should be between one-half and two times the total area of all of the driver ports 17 of the drivers. The exact total area of the output port means is so selected as to tune the system for the desired fundamental and harmonic frequencies.

Where a single horn 8 is used, as shown in FIG. 1, the apparatus will normally be mounted with the coinciding axes of its resonance chamber 7 and its horn 8 oriented vertically, and the horn will be nondirectional. In that case the apparatus will usually be mounted with its horn projecting downward, so that the flared mouth 30 of the horn cooperates with the surface of the earth to restrict vertical dispersion of the projected sound and thereby concentrate it for maximum horizontal dispersion. Obviously, the apparatus shown in FIG. 1 could be arranged to beam its output in a desired direction by mounting it with its axis horizontal; and in that case it can be arranged for rotation about a vertical axis to produce a siren output that is heard as a tone of regularly rising and falling volume.

Figure 5:
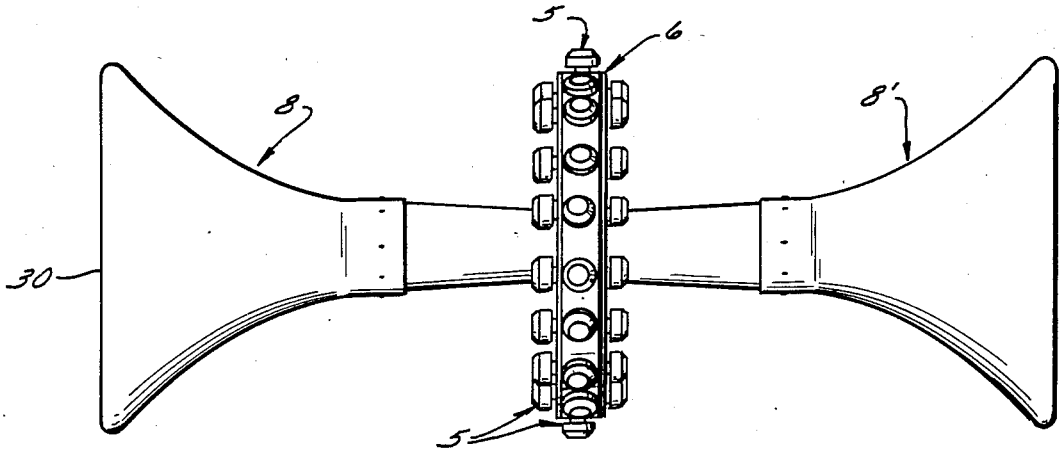
FIG. 5 is a view in side elevation of a bidirectional apparatus of this invention.

In apparatus such as is illustrated in FIG. 5, wherein two horns are used, projecting in axially opposite directions, the horns will usually be substantially directional, so that sound output will be projected as two opposite-direction beams, and the coinciding axes of the resonance chamber and of the two horns will therefore usually be oriented horizontally. Even with two horns, the apparatus is very compact in relation to its power, and therefore it lends itself well to bodily rotation about a vertical axis.

Figure 6:
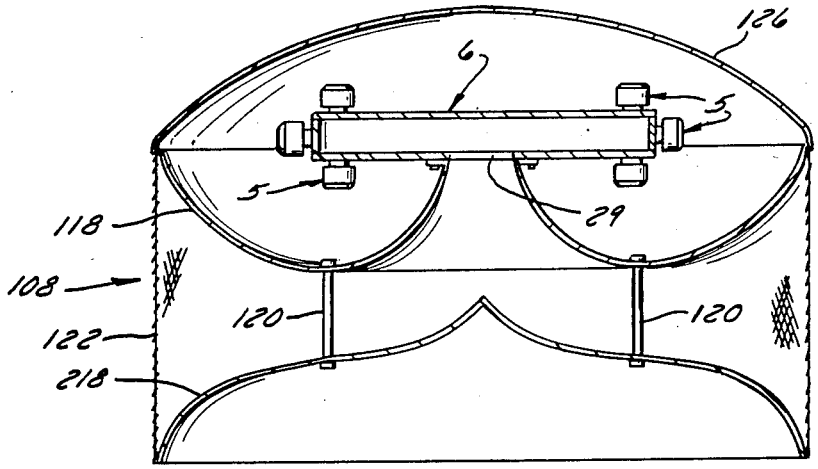
FIG. 6 is a view in vertical section of an omni-directional apparatus.

FIG. 6 illustrates another omni-directional embodiment of the invention wherein tne rigid structure has its axis vertical and has outlet port means 29 only in its bottom wall. The outlet port means 29 opens into the throat of an omni-directional horn 108 that comprises an upper element 118 and a lower element 218. Both of these horn elements 118, 218 are of circular planform and are substantially larger in diameter than the rigid structure and coaxial with it. The upper horn element 118 is in the shape of one half of a toroid that has been cut through on its equator, and it can be directly secured to the rigid structure with its convex surface downward. The lower element 218, in the shape of a candy kiss with its cusped surface upward, is connected in downwardly spaced relation to the upper element 118 by means of struts 120. A cylindrical screen 122 preferably extends vertically between the circular edge of the upper element and that of the lower element. An inverted-bowl-shaped weather cover 124 can overlie the upper element and cooperate with it to enclose the rigid structure and the drivers.

From the foregoing description taken with the accompanying drawings, it will be apparent that this invention provides an electronic outdoor alerting and warning apparatus which comprises a very large number of drivers cooperating to act as a single sound source but which is nevertheless very compact as well as highly efficient in converting electrical energy applied to the drivers into acoustical energy.

What is claimed as the invention is:

1. An electronic alerting and warning apparatus of the type having a plurality of substantially identical drivers, each comprising a diaphragm, means for imparting audio frequency vibrations to the diaphragm, and housing means cooperating with the diaphragm to define at a front side thereof an acoustic impedance chamber that has a restricted driver port, said apparatus being characterized by:

A. rigid means defining a substantially cylindrical resonance chamber that has a peripheral wall with an interior surface concentric to an axis and has axially opposite end walls, said resonance chamber further having
  (1) an inside diameter equal to a whole number multiple of one-quarter of the wavelength of a sound wave of a predetermined frequency,
  (2) an inside axial-depth which is not substantially greater than the diameter of said driver port,
  (3) a plurality of input ports, one for each of said drivers, spaced at substantially regular intervals around its peripheral portion, and
  (4) output port means defined by at least one aperture in at least one of said end walls, said output port means
    (a) being near said axis and substantially symmetrical to the same and
    (b) having a total area which is between about one-half and two times the sum of the areas of the driver ports of said drivers; and B. each said driver being secured to said rigid means with its driver port in register with its input port in said resonance chamber.

2. The electronic alerting and warning apparatus of claim 1 wherein only one of said end walls is apertured to define said output port means, further characterized by:

C. a horn secured to said rigid means adjacent to said one end wall and having a throat into which said output port means opens.

3. The electronic alerting and warning apparatus of claim 1 wherein each of said end walls is apertured to define said output port means, further characterized by:

C. a pair of horns, each having a throat and each secured to said rigid means adjacent to one of said end walls with the apertures in the end walls opening into the throats of the horns respectively adjacent to them.

4. The electronic alerting and warning apparatus of claim 1 wherein said input ports for at least certain of the drivers are in said peripheral wall.

5. The electronic alerting and warning apparatus of claim 1, further characterized in that
  (1) said input ports for certain of the drivers are in said peripheral wall,
  (2) said input ports for others of the drivers are in one of said end walls, adjacent to said peripheral wall, and
  (3) said input ports for still others of the drivers are in the other of said end walls, adjacent to said peripheral wall.

6. An electronic alerting and warning apparatus having a plurality of substantially identical drivers, each of which comprises a diaphragm, means for imparting audio frequency vibrations to the diaphragm, and housing means cooperating with the diaphragm to define at a front side thereof an acoustic impedance chamber that has a restricted driver port, said apparatus being characterized by:

A. rigid means having a pair of opposite end wall portions connected by a peripheral wall portion, defining a resonance chamber that has
  (1) an interior peripheral surface which is concentric to an axis and which has a diameter equal to a whole number multiple of one-fourth of the wavelength of a sound wave of a predetermined frequency, and
  (2) opposite interior end surfaces spaced apart by a distance which is not substantially greater than the diameter of said driver port;

B. said rigid means being apertured to provide
  (1) a plurality of input ports, one for each of said drivers, opening into the peripheral portion of said resonance chamber at substantially regular intervals around the same, and
  (2) output port means opening coaxially from said resonance chamber and having a total area which is substantially in the range of one-half to two times the sum of the areas of the driver ports of said drivers; and C. said drivers being secured to said rigid means at the exterior of said resonance chamber with the driver port of each driver communicated with the resonance chamber through the input port for the driver.

7. The electronic alerting and warning apparatus of claim 5 wherein said output port means opens from said resonance chamber through only one of said end wall portions of said rigid means, further characterized by:

D. a horn secured to said rigid means, said horn having a restricted throat portion into which said output port means opens.

8. The electronic alerting and warning apparatus of claim 5 wherein both of said end wall portions of the rigid means are apertured to provide said output port means, further characterized by:

D. a pair of horns, one for each of said end wall portions, each having a restricted throat, said horns being secured to said rigid means with their throats adjacent to their respective end wall portions and with the output port means opening into their throats.

* * * * *